United States Patent [19]

Herrington et al.

[11] Patent Number: 5,014,852

[45] Date of Patent: May 14, 1991

[54] PAD OF BAGS

[75] Inventors: Fox J. Herrington, Holcomb, N.Y.; James P. O'Sullivan, Sr., Fairfax, Va.

[73] Assignee: Mobil Oil Corp., Fairfax, Va.

[21] Appl. No.: 467,294

[22] Filed: Jan. 11, 1990

Related U.S. Application Data

[63] Continuation of Ser. No. 292,125, Dec. 30, 1988, abandoned.

[51] Int. Cl.[5] ..... B65D 85/62

[52] U.S. Cl. ..... 206/554; 206/460; 383/37; 383/62; 383/87

[58] Field of Search ..... 206/554, 460, 631.1, 206/632; 383/32, 37, 86, 62, 87

[56] References Cited

U.S. PATENT DOCUMENTS

| | | | |
|---|---|---|---|
| 2,709,467 | 5/1955 | Hoeppner | 150/7 |
| 2,715,493 | 8/1955 | Vogt | 229/69 |
| 2,842,179 | 7/1958 | Hoeppner | 150/7 |
| 3,309,007 | 3/1967 | Rosenberg et al. | 229/55 |
| 3,348,762 | 10/1967 | Kasinkas | 229/80 |
| 3,420,433 | 1/1969 | Bostwick | 229/80 |
| 3,510,052 | 5/1970 | Ruda | 229/62 |
| 3,857,731 | 12/1974 | Merrill et al. | 117/122 |
| 3,915,302 | 10/1975 | Farrelly et al. | 206/554 |
| 3,990,627 | 11/1976 | Olson | 229/62 |
| 4,332,347 | 6/1982 | Clayton | 229/62 |
| 4,502,599 | 3/1985 | Perecman | 206/554 |
| 4,513,445 | 4/1985 | Kamp | 383/87 |
| 4,630,310 | 12/1986 | Winesett | 383/37 |
| 4,630,891 | 12/1986 | Li | 350/105 |
| 4,674,634 | 6/1987 | Wilson | 206/554 |
| 4,677,684 | 6/1987 | Gatward | 383/87 |
| 4,759,643 | 7/1988 | Canno | 383/84 |
| 4,785,940 | 11/1988 | Wilson | 206/632 |
| 4,790,670 | 12/1988 | Barbaro | 383/62 |

FOREIGN PATENT DOCUMENTS

| | | | |
|---|---|---|---|
| 1331643 | 9/1973 | United Kingdom | 383/87 |
| 2066208 | 7/1981 | United Kingdom | 206/632 |

*Primary Examiner*—David T. Fidei

*Attorney, Agent, or Firm*—Alexander J. McKillop; Charles J. Speciale; James P. O'Sullivan, Sr.

[57] ABSTRACT

A pad of a plurality of sealable-unsealable bags comprising a stack of the bags, each bag comprising a front and rear wall closed at the sides and bottom and having a region of access to between the walls; a closure flap as an integral extension of the back wall, the flap having an inside and an outside surface relative to the bag in its sealed condition; an adhesive region located on a portion of the inside surface of the flap; and at least the adhesive-bearing portion of said flap being reverse-folded, outside surface-to-outside surface and the adhesive-bearing inside surface positioned in releasable adhesive contact with a non-adhesive bearing portion of the inside surface of the flap of a preceding bag in the stack.

9 Claims, 1 Drawing Sheet

PAD OF BAGS

This is a continuation of copending application Ser. No. 292,125, filed on Dec. 30, 1988, now abandoned.

BACKGROUND OF THE INVENTION

This invention relates to an improved pad of sealable-unsealable bags and of particular interest is a pad of such bags made of polymeric film material.

One species of polymeric film bag of the type contemplated herein is that packaged in a roll with each individual bag joined to the bottom or top of the next successive bag along a perforated line. Bags of this type also are formed individually and presented in a stack which is placed in a bag or box. Bags of this type may be individually removed from the roll or from the box. Access to the opening of the bag must, of course, be located in order to place an article of interest in the bag. For closure these bags employ twist ties, zipper-type fasteners, flip-over hood type cuffs or an adhesive stripe below the bag opening is employed to close the bag.

U.S. Pat. No. 4,502,599 issued to Perecman, discloses a collection of bags mounted on a rigid support card. The individual bags are stacked one upon the other, in registration, with the access region to the interior of the top most bag facing the user. An upper closure flap has exposed to the user an adhesive stripe extending across this flap. In use a packager would find access to the bag opening, but in placing the desired object in the bag, it will easily come into contact with the adhesive stripe. This type of arrangement is undesireable for the packaging of many items. For home use, where food products such as sandwiches, raw vegetables, fruit, and the like are bagged, the food will contact and adhere to the adhesive region of this type of bag. This not only interferes with the subsequent sealing of the bag flap but is a messy and unsanitary situation.

U.S. Pat. No. 2,715,493, issued to Vogt, describes a collection of bags entitled "chained enwrapments". This patent describes a collection of envelopes of the type having a front panel and a back panel wherein the back panel extends beyond the front panel. As is common practice, the envelopes or bags are closed at two opposite sides and also at the bottom. In the described collection of bags, the extended flap has an adhesive region across the surface which will become the inside surface of the closed and sealed envelope. This flap however is reverse folded backwards on itself and positioned so as to come into adhesive contact with the front panel of the next adjacent envelope. Thus, the adhesive on the flap extension of one envelope is placed in adhesive contact with the top of the non-adhesive bearing front panel of the next adjacent envelope. The purpose of this arrangement is so as to permit automatic or semi-automatic filling of the envelopes by placing the chained envelopes upright with the envelope bottom edges in contact with a planar surface. A plurality of the chained envelopes are simultaneously opened by pulling on the front panel of the first envelope. Since all envelopes are adhesively linked together, they will all open somewhat in the fashion of extending an accordion pleat. This will permit rapid filling of a plurality of these envelopes by permitting the envelopes to pass beneath a stream of commodity or material. The type of adhesive disclosed in this patent is of the type which needs to be activated to form the chained envelopes and then again after the envelopes have been filled in order to unseal envelopes from the chain and then again to seal the envelopes. It also must be of a type which will not cause adherence of the commodity to the adhesive during filling. Envelope collections of this type are impractical and have very limited utility.

U.S. Pat. 3,348,762 issued to Kasinkas discloses bag structure which is of the general type which is of interest in the instant invention but its specific structure and its presentation as a convolutely rolled package is not desirable. It also has specific structural limitations designed to maintain the adhesive portion of one bag out of contact with any succeeding bag while in the rolled condition. With this type of rolled package the user would withdraw one bag from the rolled package and sever it along perforation lines to separate it from the next bag. The suer then has bag which suffers from the same disadvantages as the structure defined in the aforementioned '599 patent. That is, once the bag is separated from the roll any food items which are attempted to be inserted into the bag are likely to come into contact with the adhesive surface resulting in a messy, unsanitary and imperfectly sealed structure.

It is an object of the present invention to provide a pad of bags not possessed of the shortcomings of the above identified prior art.

It is another object to the invention to provide a pad of bags which provides easy access to the interior of the first bay without contact to the sealing means during the process of bag filling.

A further object is to provide a pad of registered sandwich bags where each bay is in position to be filled while still a member of the pad.

Yet another object is to provide a pad of registered bags where each bag is releasably fixed in registration prior to use.

Still another object is to provide a method or loading, closing and sealing a bag.

SUMMARY OF THE INVENTION

The present invention is concerned with a pad of sealable-unsealable envelopes comprising: a stack of said envelopes, each envelope comprising the following structure: a front and rear wall closed at the sides and bottom and having region of access between the walls. A closure flap is an integral extension of the back wall. This flap has an inside surface and an outside surface relative to the envelope in tis sealed condition. An adhesive region is located across at least a portion of the inside surface of the flap. The adhesive-bearing portion of each envelope flap is reverse-folded and each envelope is positioned relative to the next so that each reverse-folded flap is in releasable adhesive contact with anon-adhesive bearing portion of the inside surface of the flap of preceding envelope in the envelope stack.

The present invention is also concerned with a simple, but effective method of presenting for bag-loading, each bag of a bag pack, comprising loading the bag while still a part of the bag pack and after the bag is loaded, separating the reverse folded portion of the flap from the bag pack and bringing the adhesive portion of the flap down to the closure position thereby sealing the bag closed.

DETAILED DESCRIPTION OF THE INVENTION

Figure 1:
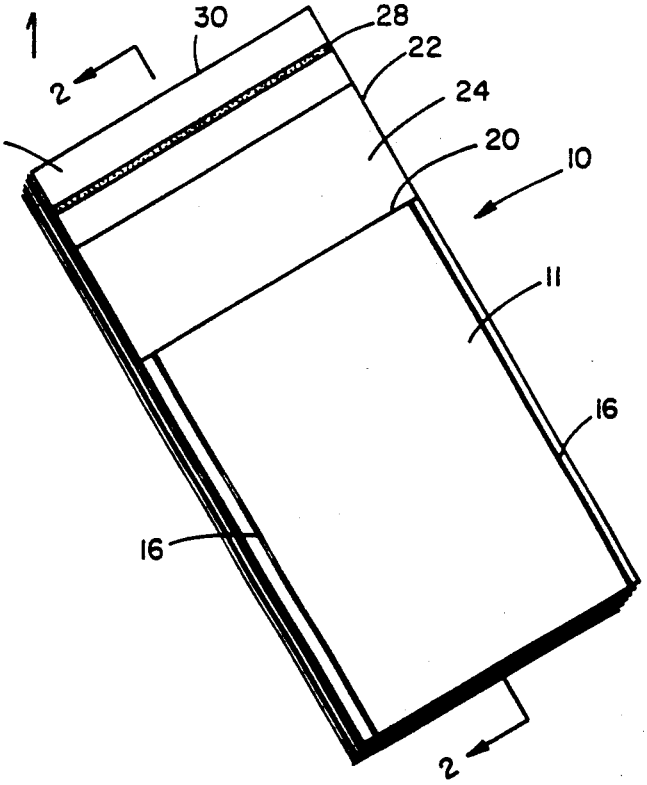
FIG. 1 is a perspective view of a pad of bags or envelopes within the scope of the present invention.
Figure 2:
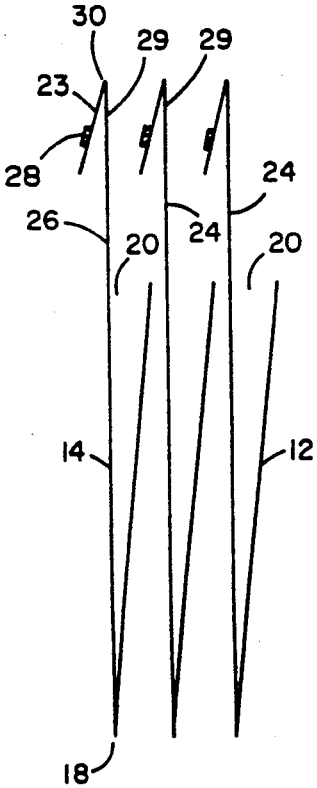
FIG. 2 is a sectional view taken along the lines 2—2 of FIG. 1 and for simplicity showing only the top three bags in a separated relationship.

The present invention is best illustrated in reference to a pad of bags of the type which would be employed to package sandwiches made in the home. These bags are commonly known as "sandwich bags". The pad of bags illustrated in FIGS. 1 and 2 is made from a transparent thermoplastic film material such as polyethylene. It will be understood, as indicated in greater detail below, that other materials can be employed for manufacturing the structure.

A pad of bags 10 is represented in FIG. 1. This stack of bags can include an convenient number of bags placed generally in registration one on top of the other. Bag 11 is the first individual bag in the pad of bags shown. This bag has a front wall 12, better shown in FIG. 2, and a rear wall 14 also better shown in FIG. 2. Both of these walls are side sealed as at 16. The bag has a bottom closure 18 which in most cases will consist of the fold point between the front wall and the rear wall. There is a region of access into the bag designated at 20 which extends along the front upper edge of front wall 12. Rear wall 14 has, as an intergal extension thereof, a closure flap 22 that extends beyond the length of front wall 12. An upper marginal region 23 of the closure flap is reverse folded at fold line 30 back on itself. Closure flap 22 has an inside surface 24 and an outside surface 26 relative to said bag in its closed or sealed condition. An adhesive region 28 extends laterally across the reverse folded margin 23. The stripe of adhesive 28 shown in FIG. 1 is carried by marginal region 23 which of course is reverse folded back on itself. The adhesive band or stripe 28 is visible in FIG. 1 because the film is transparent and the adhesive opaque. FIG. 2 illustrates the first three bags of the pad of bags shown in FIG. 1. These three structures are shown taken on the line 2—2 of FIG. 1 and for clarity of illustration are shown slightly separated from one another. It is to be understood that tin the pad arrangement of this plurality of bags, each would be collapsed planarly so that adhesive stripe or band 28 of bag 1 would be in adhesive contact with region 29 of the preceding bay and so forth.

Figure 3:
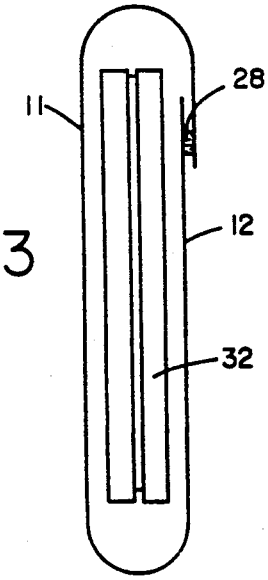
FIG. 3 is a side sectional view taken along the lines 3—3 of FIG. 4, of an individual bag containing a packaged item.
Figure 4:
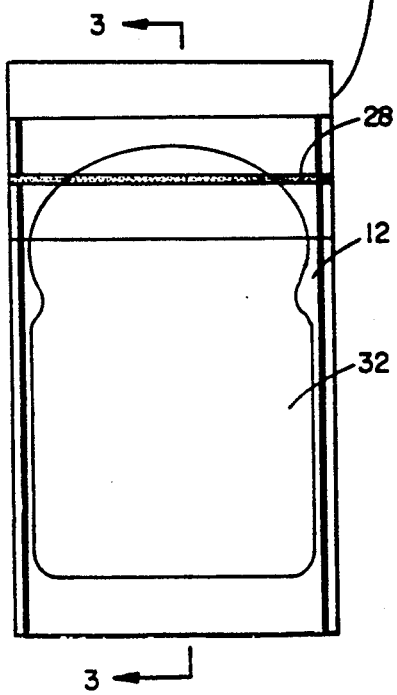
FIG. 4 is a front view of an individual bag containing a packaged item.

In use the user would position the pad of bags on a flat, horizontal, vertical or sloping surface, and access the interior of the bag by separating the front panel from the back panel, all while the bag is still attached to the pad. An item such as a sandwich can then be inserted into the bag. While so doing, contact can be made all across the inside surface 24 of closure flap 22 and no contact will be made with the adhesive stripe since it is on a portion of the closure flap which is reverse-folded and in contact with the inner surface 24 of the next bag in the pack. The disadvantage of prior art structures is thereby avoided. After the bag is loaded, the closure flap is peeled form the pad an the marginal region carrying adhesive stripe 28 is brought from its reverse-fold position so that the adhesive stripe can be moved below region of access 20 and pressure sealed against front panel 12 to effect closure of the bag. FIGS. 3 and 4 illustrate an individual bag 11 containing an item 32, e.g., a sandwich, with adhesive stripe 28 making adhesive closure contact with front panel 12.

As will be appreciated from the arrangement and construction of the pad of bags shown in the figures, the access regions of all the bags following the outermost bag are in an isolated and protected condition by virtue of each preceeding bag. This keeps the access region of each bag in a clean, uncontaminated condition. Because of the location of the adhesive stripe 28 carried on the reverse-folded region 23, it remains unexposed to any contaminating material until the time of sealing it to front panel 12.

It is to be understood that the reverse-fold line of each bag is preferably spaced from the bottom of the bag within the range of from (1) the same distance as (2) to a farther distance than the distance from the bottom of the bag to the top edge of the front wall of the bag. The collection of bags are at least generally in registration after formation thereof. It is preferred that the reverse-fold line of each bag in the pack is spaced a distance from the bottom edge of the bag which is a farther distance than the distance from the bottom of the bag to the top edge of the front wall of the bag. This further distance will provide a double film thickness slide panel which will be of sufficient length to facilitate sliding objects to said region of access and into the bag.

The precise method of loading, closing and sealing a bag of a pad of bags comprises:

(a) positioning said pad so that the object to be loaded can be brought to the slide panel and the region of access while the bag to be loaded is still part of said pad;

(b) bringing the object to be loaded to said slide panel, sliding it past said region of access into said bag;

(c) separating the loaded bag from said pad;

(d) turning the adhesive-bearing flap from the outside-in condition to the inside-in condition; and (e) closing and sealing said bag by applying adhesion pressure to between the adhesive and corresponding area of said front wall below the top edge of the front wall.

It is to be understood that the structure described is applicable to a variety of containers and bags. As indicated, the pad of bags can be of the type known as sandwich bags. In addition, bags of any utility can be assembled and structured and formed into a pad of bags as described. Furthermore, the structure can be utilized for a pad of more rigid containers employed to package fast food items such as french fries, pizza or pizza slices and other finger foods. The described pad of bags can also be employed to package dry goods such as clothing, hardware, etc. The pad of bags is ideally suited for rapid individual packaging and sealing of items. As employed herein the terms "bag" and "envelope" are to be understood as equivalent structures.

The adhesive which is applied to the envelope or bag flap is preferably of the non-curing, pressure sensitive type. This adhesive must preferentially adhere to the region of the inside of the flap to which it has been originally applied but less aggressively adhere to other regions of the bag or envelope. This is accomplished by an suitable treatment of the surface of the portion of the flap where the adhesive is to be applied. Such treatment may be made by corona discharge, chemical treatement or flame treatment. The purpose of this treatment is to ensure that the adhesive has sufficient surface affinity for the region of the flap film to which it is applied and this affinity is greater than the affinity for the film making up the rest of the bag. It has been found that when using certain acrylic latexes and a plastic web having a wetability of 30 dynes/centimeter or less to make a bag, the wetability of the pre-treated surface of the portion of the bag flap where the adhesive is to be applied should be in the range of about 37 to about 40 dynes/-centimeter.

It is to be understood that the adhesive can be applied as a stripe, a line of space-interrupted dots or dashes, individual splotches or a series of thin parallel lines. The film should be pre-treated so as to be firmly receptive to the adhesive.

One means of preparing a region of the film which is or will become the inside surface of the flap of the subject envelopes is to present this surface to a corona-discharge influence. This can be accomplished by passing the film over a metal drum which has a corona-discharge unit mounted in vertical alignment in relation thereto. The metal drum has a surface coating of a durable dielectric material adhered thereto. The corona-discharge unit comprises a metal conductor which has an arcuate knife edge electrode or wire which conforms to the contour of the drum and which overlies the section of the film to be treated. The film is passed over the electrically conductive drum and maintained in contact therewith. A suitable source, e.g. a generator, applies a high voltage to the electrode. The high voltage charge on the electrode jumps the air gap between the electrode and the film strip as it passes over the drum. The gap voltage, generated in the air space between the electrode and the film surface, ionizes the ambient atmosphere, e.g., air, proximate thereto. The ionized zone thus formed acts as an oxidizing agent and oxidizes a defined region adjacent to the electrode. For example, a voltage of 500 volts applied to a suitable knife edge electrode with an electrode gap of 1/16 of an inch and an electrode gap length of 3 1/16 inches are maintained. Polymeric film passing at a rate of 500 feet per minute can be corona-discharge treated under these conditions. These conditions will oxidize a strip slightly more than ¼ inch wide on the film surface. This will permit an approximately ¼ inch strip of pressure-sensitive adhesive to be continually applied to this oxidized area by means of a suitable transfer roll of conventional design. The adhesive can be dried and heat set by passing the applied adhesive through an oven at 150° F. An adhesive applied to a polyethylene film treated in this manner will firmly adhere to the surface. This pressure-sensitive adhesive will effect an adherent closure when pressed against non-treated portions of the film, yet a comparatively minor peeling force will separate the pressure-sensitive adhesive from the non-treated surface.

Caution has been given in the prior art, e.g., U.S. Pat. No. 3,348,762 issued to Kasinkas, that care be taken to prevent "strike-through" which is an excessive corona-discharge of such magnitude that oxidation of the film extends through the film so that the upper and lower surfaces of the film are approximately equally oxidized. If this should occur, in structures of the prior art, then the adhesive could come into contact with an oxidized surface of an adjacent bag structure and non-destructive separation of adjacent bags could not be obtained. However, because of the arrangement and construction of the bags of the present invention this cannot happen because even if "strike-through" occurs, the flaps of the present invention are reverse folded. Therefore, any "strike-through" region is always hidden out of contact with any pressure sensitive adhesive available from an adjacent bag or envelope in the bag pad or stack. Thus, there are greater manufacturing tolerances available during the manufacture of bags and bag pads of the present invention than with prior art structures.

Another preferred adhesive arrangement which can be applied to the flap of the described bag is that defined in U.S. Pat. No. 3,857,731 which is incorporated by reference in its entirety herein. This repeatedly usable pressure-sensitive adhesive combination comprises the bag or envelope flap as the substrate to which is bonded a thin layer of a binder material, said binder having partially embedded in and protruding from its exposed surface inherently tacky elastomeric copolymer microspheres. The microspheres consist essentially of:

a. about 90 to about 99.5 percent by weight of one or more oleophilic, water-emulsifiable alkyl acrylate esters, at least one of said esters being selected from the group consisting of iso-octyl acrylate, 4-methyl-2-pentyl acrylate, 2-methylbutyl acrylate, and sec-butyl acrylate and correspondingly
b. about 10 to about 0.5 percent by weight of one or more monomers selected form the group consisting of trimethylamine methacrylimide, trimethylamine p-vinyl benzimide, ammonium acrylate, sodium acrylate, N,N-dimethyl-N-(-methacryloxyethyl) ammonium propionate betaine, 1,1-dimethyl-1-(2-hydroxypropyl) amine methacrylimide, 4,4,9-trimethyl-4-azonia-7-oxo-8-oxa-9-decene-1-sulphonate, 1,1-dimethyl-1-(2,3-dihydroxypropyl) amine methacrylimide, and maleic anhydride.

In manufacturing bag pads of the present invention polyethylene film is currently a preferred material. The term polyethylene is employed in a generic sense to include low density polyethylene, high density polyethylene, linear low density copolymers of ethylene and another alpha-olefin having from 4 to 10 carbon atoms. Other films may be employed in forming the envelopes or bags for example, polyvinyl chloride, cellulose acetate, polyvinyl acetate, polyvinylidene chloride, polypropylene, polyamides e.g., various nylons, various papers and paper boards, various film laminates, etc. The film thickness is not important and should be consistent with the economies of the ultimate bag or envelope use. The film therefore can range from less than about 0.1 mil to in excess of 20 mils.

Other specific pressure-sensitive adhesives include an acrylic base adhesive of the type sold by Interchemical Co. and known as adhesive No. 4043, acetate adhesives, rubber base adhesives and vinylidene chloride adhesives. These are representative and not intended to be limited. The adhesives can include any suitable opacifying pigment such as titanium dioxide so that the adhesive strip on the bag flap is readily distinguishable from the remainder of the film. The film itself can be transparent, tinted or opaque. As indicated above, the adhesive can be anchored to the substrate either by treating the surface or using a binder or both.

A suitable technique for forming a pad of bags within the scope of the present invention involves the following. A 12½ inch wide roll of film is unwound and corona-discharge treated as described along a ¼ inch stripe and a pressure-sensitive adhesive applied to the treated stripe. The corona-discharge treatement is effected in the manner described above. The stripe is located approximately ⅜ of an inch inward from one edge of the film. The opposite edge of the film is overfolded onto itself so as to form a front panel approximately 5 inches in width leaving an approximately 2½ flap extending beyond the back panel, which extension carries the adhesive strip. The adhesive stripe can be applied in interrupted lengths so as to provide small regions in between bags to accommodate side sealing of the bags and so as not to contaminate the side sealing means with adhesive.

The side sealing means heat seals the sides of the bag together so as to produce a bag having a dimension of approximately 6½inches between seals. Thereafter, a turning board reverse folds back on itself, a 1 inch portion of the flap which carries the adhesive stripe. Differential speed rollers separate the individual bags and the bags are stacked in registration so that the adhesive stripe of one reverse folded portion of the bag flap is non-aggressively adhered to the upper inside surface of the flap of the next adjacent bag. This is repeated until a bag pad of approximately 50 registered bags is formed.

By this technique and arrangement, a pad of registered bags, as shown in FIG. 1, is formed and the first bag in the pad is ready for filling while still attached to the pad. It is to understood that the container structure can have gusseted or accordian pleated sides or bottom.

Other pressure-sensitive adhesives suitable for use herein are disclosed in U.S. 3,915,302, the disclosure of which is incorporated herein in its entirety by reference.

The scope of the present invention should not be limited to the structures and materials disclosed in the specification of the claims should be given the usual reasonable interpretation in view of the circumstances of their examination and allowance.

We claim:

1. A pad of a plurality of sealable-unsealable bags comprising:

a stack of bags, each bag comprising:

a front and rear wall closed at the sides and bottom and having a region of access to between said walls;

a closure flap as an integral extension of said rear wall, said closure flap having an inside and an outside surface relative to said bag in its sealed condition the inside surface being that surface adjacent said front wall;

an adhesive region located on a portion of the inside surface of said flap; and at least the adhesive-bearing portion of the flap of each bag being reverse-folded, outside surface-to-outside surface so that the adhesive-bearing portion of the inside surface of said closure flap is positioned in releasable adhesive contact with a non-adhesive bearing portion of an inside surface of another closure flap of a preceeding bag in said stack.

2. The pad of claim 1 wherein said bags are comprised of an organic polymeric film material.

3. The pad of claim 2 wherein said adhesive is a pressure sensitive adhesive.

4. The pad of claim 3 wherein the adhesive will preferentially adhere to its original region of application as compared to its adhesion to any other region of said bag.

5. The pad of claim 4 wherein said bags are at least generally in registration.

6. The pad of claim 3 wherein the inside surface of the region of polymeric film intended to receive the pressure sensitive adhesive, has been treated so as to cause preferential adhesion of the adhesive to the treated surface as compared with its adhesion to untreated film surfaces.

7. The pad of claim 5 wherein said inside surface has been treated by corona discharge means or by application of a binder material or both prior to application of a pressure sensitive adhesive.

8. The pad of claim 5 wherein said pressure sensitive adhesive includes inherently tacky copolymer microspheres consisting essentially of:

a. about 90 to about 99.5 percent by weight of one or more oleophilic, water-emulsifiable alkyl acrylate esters, at least on of said esters being selected form the group consisting of iso-octyl acrylate, 4-methyl-2-pentyl acrylate, 2-methylbutyl acrylate, and sec-butyl acrylate and correspondingly b. about 10 to about 0.5 percent by weight of one or more monomers selected from the group consising of trimethylamine methacrylimide, trimethylamine p-vinyl benzimide, ammonium acrylate, sodium acrylate, N,N-dimethyl-N-(-methyacryloxyethyl) ammonium propionate betaine, 1,1-dimethyl-1-(2-hydroxypropyl) amine methacrylimide, 4,4,9-trimethyl-4-azonia-7-oxo-8-oxa-9-decene-1-sulphonate, 1,1-dimethyl-1-(2,3-dihydroxypropyl) amine methacrylimide, and maleic anhydride.

9. The pad of claim 2 wherein the reverse-fold line of each bag is spaced from the bottom of the bag a farther distance than the distance from the bottom of said bag to the top edge of the front wall of said bag so as to provide a slide panel to facilitate sliding objects to said region of access and into said bag.

* * * * *